US005343215A

United States Patent [19]

Tanaka

[11] Patent Number: 5,343,215

[45] Date of Patent: Aug. 30, 1994

[54] AC REFRESH TYPE PLASMA DISPLAY SYSTEM UNIFORMLY ILLUMINATING PIXELS

[75] Inventor: Akio Tanaka, Tokyo, Japan

[73] Assignee: NEC Corporation, Tokyo, Japan

[21] Appl. No.: 917,410

[22] Filed: Jul. 23, 1992

[30] Foreign Application Priority Data

Jul. 29, 1991 [JP] Japan ..... 3-188498

[51] Int. Cl.[5] ..... G09G 3/28

[52] U.S. Cl. ..... 345/63; 345/214

[58] Field of Search ..... 340/765, 771, 784, 805, 340/811, 812; 345/60, 63, 68, 77, 147, 214, 215

[56] References Cited

U.S. PATENT DOCUMENTS 4,859,910 8/1989 Iwakawa et al. ..... 315/169.1

5,010,326 4/1991 Yamazaki et al. ..... 340/784

5,119,085 6/1992 Yamazaki ..... 340/784

*Primary Examiner*—Jeffery Brier

*Attorney, Agent, or Firm*—Sughrue, Mion, Zinn, Macpeak & Seas

[57] ABSTRACT

An AC refresh type plasma display panel system drives scanning electrodes in sequential manner with a first address pulse signal and a hold pulse signal and data electrodes in selective manner with a second address pulse signal, and forms visual images on a matrix of pixels addressable with the scanning electrodes and the data electrodes, wherein the frequency of the hold pulse signal is variable with the number of illuminated pixels on each scanning line so that the luminance of each pixel is kept constant.

14 Claims, 6 Drawing Sheets

AC REFRESH TYPE PLASMA DISPLAY SYSTEM UNIFORMLY ILLUMINATING PIXELS

FIELD OF THE INVENTION

This invention relates to an AC refresh type plasma display system and, more particularly, to a controlling unit for driving an electrode array incorporated in a plasma display panel unit.

DESCRIPTION OF THE RELATED ART

A typical example of the AC refresh type plasma display system is illustrated in FIG. 1 of the drawings, and largely comprises a plasma display panel unit 1 with scanning electrodes 1*a* and data electrodes 1*b*, a driver unit 2 for the scanning electrodes 1*a*, a driver unit 3 for the data electrodes 1*b*, and a controlling unit 4 responsive to an image carrying signal for controlling the drivers 2 and 3. The scanning electrodes 1*a* and the data electrodes 1*b* form in combination an electrode array, and the electrode array selectively illuminates a matrix of pixels so as to reproduce images carried on the image carrying signal. The structure of the panel display unit 1 is well-known to a person skilled in the art as disclosed in U.S. Pat. No. 4,859,910, and no further description is incorporated hereinbelow.

The scanning electrodes 1*a* are coupled through scanning signal lines Y1, Y2, Y3, Y4, Y5, Y6, . . . Ym, Ym+1, . . . and Ys with the driver unit 2, and the data electrodes 1*b* are coupled through data signal lines X1, X2, X3, X4, X5, X6, . . . XN, . . . and Xt with the driver unit 3. The controlling unit 4 controls the driver units 2 and 3 so as to sequentially drive the scanning signal lines Y1 to Ys and to selectively drive the data signal lines X1 to Xt, and the matrix of pixels is addressable with the scanning signal lines Y1 to Ys and the data signal lines X1 to Xt. For example, pixel D(Xn, Ym) is illuminated with the scanning signal line Ym and the data signal line Xn, and the scanning signal line Ym+1 and the data signal line Xn illuminate another pixel labeled with D(Xn, Ym+1).

Description is hereinbelow made of the control sequence applied to the prior art AC refresh type plasma display system with reference to FIG. 2. Assuming now that the image carrying signal requests the controlling unit 4 to illuminate pixel D(Xn, Ym) and to put pixel D(Xn, Ym+1) out (i.e., turn the pixel off), the controlling unit 4 supplies a low frequency address pulse train to the driver unit 2 for driving the scanning signal line Ym with a low frequency driving pulse signal AD at time t1 and t3, and further supplies the driver unit 3 with a low frequency antiphase address pulse train for driving the data signal line Xn with a low frequency antiphase driving pulse signal AAD at times t2 and t4. Then, a composite driving pulse train CAD addresses pixel D(Xn, Ym), and the pulse height of the composite address driving pulse train CAD is larger than the break-down voltage or the critical voltage level for discharging. Then, the discharging phenomenon takes place at pixel D(Xn, Ym), and is continued after removal of the antiphase driving pulse train AAD due to the charged particles in the excitation state. For this reason, only a high frequency hold pulse train is supplied from the controlling unit 4 to the driver unit 2 for driving the scanning signal line Ym with a high frequency driving pulse train HD at time t5, and maintains the discharging phenomenon.

In order to put pixel D(Xn, Ym+1) out, the controlling unit 4 causes the driver unit 2 to supply the low frequency driving pulse train AD to the scanning signal line Ym+1 at times t6 and t7, and causes the driver unit 3 to supply a low frequency in-phase driving signal IAD to the data signal line Xn in synchronism with the low frequency driving pulse train AD. The composite driving pulse train CAD addresses pixel D(Xn, Ym+1), and the pulse height of the composite driving pulse train CAD is lower than the break-down voltage level. Then, the discharging phenomenon at pixel D(Xn, Ym+1) is terminated, and the controlling unit 4 puts pixel D(Xn, Ym+1) out. Since no charged particles are excited, no discharging phenomenon takes place in the presence of the high frequency driving pulse train HD on the scanning signal line Ym+1.

However, a problem is encountered in the prior art AC refresh type plasma display system in that the luminance of a pixel is variable with the number of illuminated pixels on the same scanning signal line. In detail, each of the scanning signal lines Y1 to Ys are shared between the pixels respectively accompanied with the data signal lines X1 to Xt. Thus the high frequency driving pulse trains HD are distributed to all the pixels illuminated with the low frequency antiphase driving pulse trains AAD on the respective data signal lines. If a relatively small number of the pixels on a scanning signal line are illuminated, the high frequency driving pulse train HD can distribute sufficient current to the associated data signal lines of the illuminated pixels. However, if a relatively large number of pixels on the scanning signal line are illuminated, the scanning signal line must distribute a large amount of current between the data signal lines associated with the illuminated pixels. This however, tends to deform the high frequency driving pulse train HD due to the impedance of the driver unit 2. Of course, reduction of the impedance improves the problem; however, the semiconductor chip for the driver unit 2 must thereby be enlarged, and the large sized semiconductor chip deteriorates the production yield. Thus, the solution, i.e., the reduction of the impedance produces another problem.

SUMMARY OF THE INVENTION

It is therefore an important object of the present invention to provide an AC refresh type plasma display system which uniformly illuminates a matrix of pixels without sacrifice of production yield.

To accomplish the object, the present invention proposes to vary the number of hold pulses together with illuminated pixels.

In accordance with the present invention, there is provided an AC refresh type plasma display system for reproducing visual images represented by visual information, comprising: a) a plasma display panel unit having a plurality of scanning electrodes respectively associated with a plurality of scanning lines, and a plurality of data electrodes for forming a plurality of addressable pixels, the visual information having pieces of visual information respectively assigned to the scanning lines, each of the pieces of visual information designating pixels on the associated scanning line to be illuminated; b) a first driver unit coupled with the plurality of scanning electrodes, and responsive to a first address pulse signal and a hold pulse signal for sequentially driving the plurality of scanning electrodes; c) a second driver unit coupled with the plurality of data electrodes, and responsive to a second address pulse signal for selectively driving the plurality of data electrodes, thereby selectively illuminating the plurality of pixels for reproducing the visual images; and d) a controlling unit coupled with the first and second driver units for distributing the first address pulse signal, the hold pulse signal and the second pulse signal, and comprising d-1) a correction value producing means responsive to each of the pieces of visual information, and operative to calculate a correction value from the aforesaid each of the pieces of visual information, the correction value being indicative of either increment or decrement of the hold pulse signal, d-2) a calculating means supplied with the correction value and an initial value indicative of a standard frequency of the hold pulse signal, and operative to calculate a modified frequency for the hold pulse signal, and d-3) a signal generating means coupled with the calculating means for producing the hold pulse signal.

The AC refresh type plasma display panel system according to the invention drives the scanning electrodes in sequential manner with the first address pulse signal and the hold pulse signal, and drives the data electrodes in selective manner with a second address pulse signal. The display panel system forms visual images on a matrix of pixels addressable with the scanning electrodes and the data electrodes, wherein the frequency of the hold pulse signal is variable with the number of illuminated pixels on each scanning line so that the luminance of each pixel is kept constant.

BRIEF DESCRIPTION OF THE DRAWINGS

The features and advantages of the AC refresh type plasma display system according to the present invention will be more clearly understood from the following description taken in conjunction with the accompanying drawings in which.

DESCRIPTION OF THE PREFERRED EMBODIMENT

Figure 1:
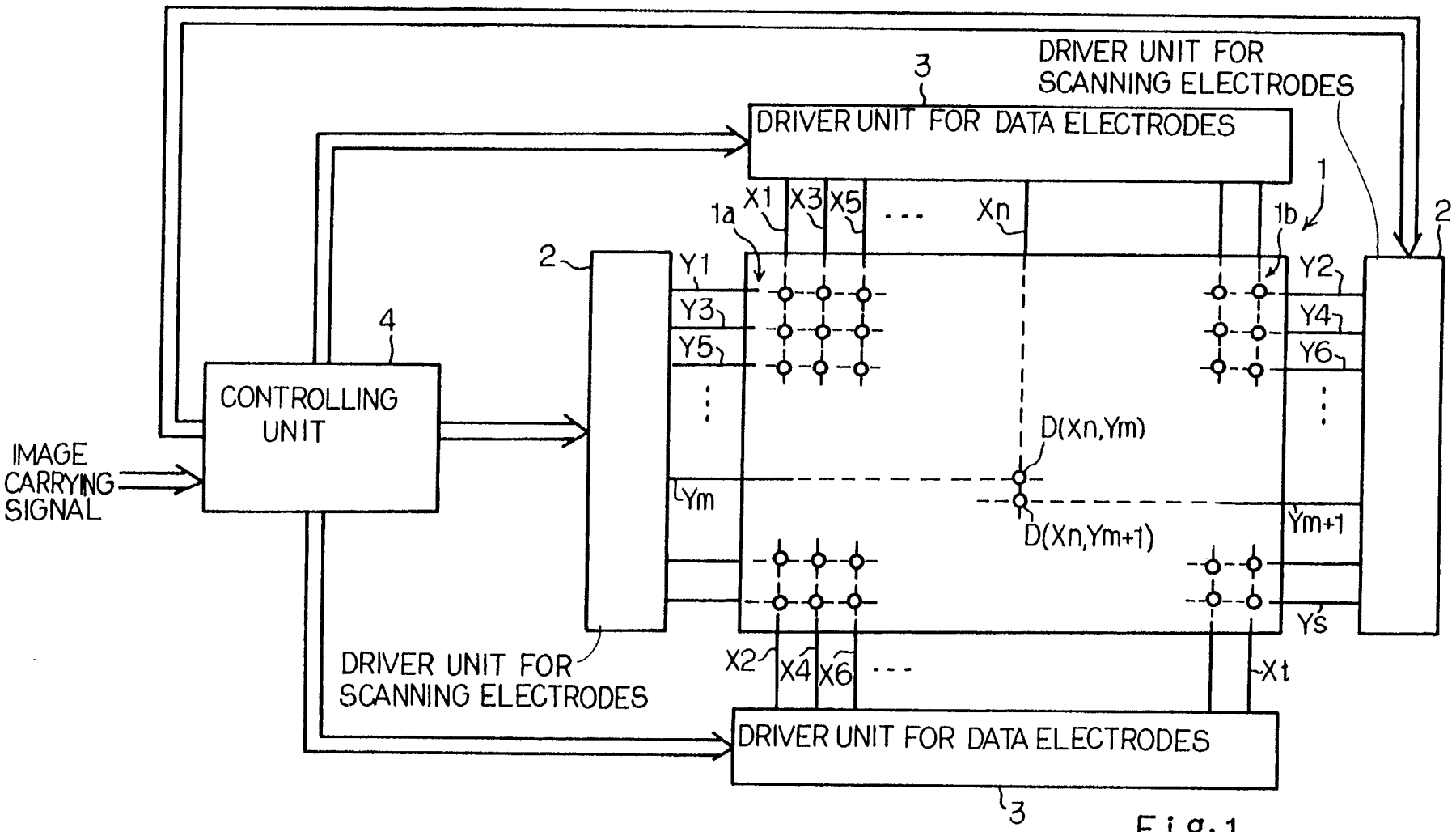
Fig·1 PRIOR ART
FIG. 1 is a block diagram showing the arrangement of the prior art AC refresh type plasma display system.
Figure 2:
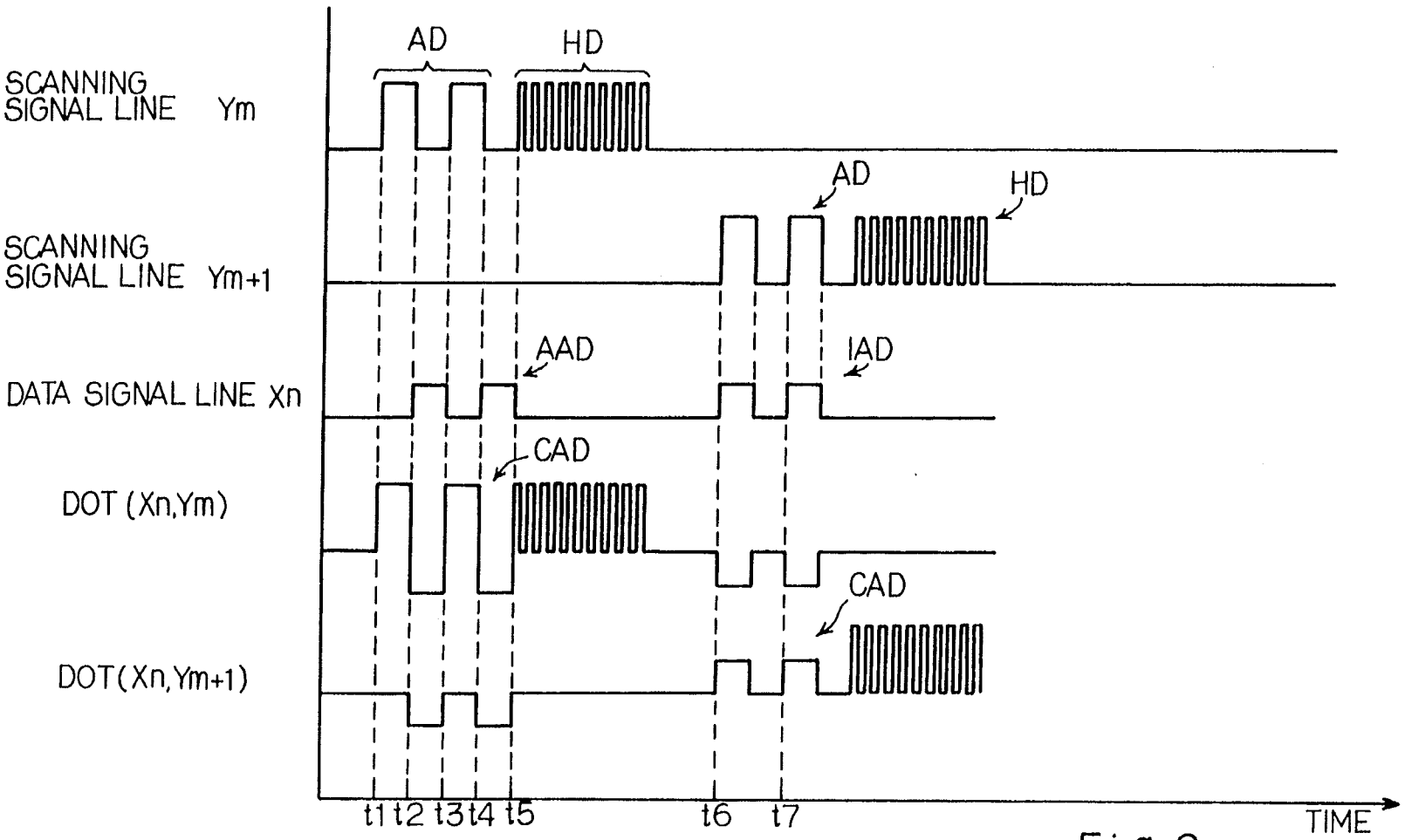
Fig. 2 PRIOR ART
FIG. 2 is a diagram showing the controlling sequence of the prior art AC refresh type plasma display system.
Figure 3:
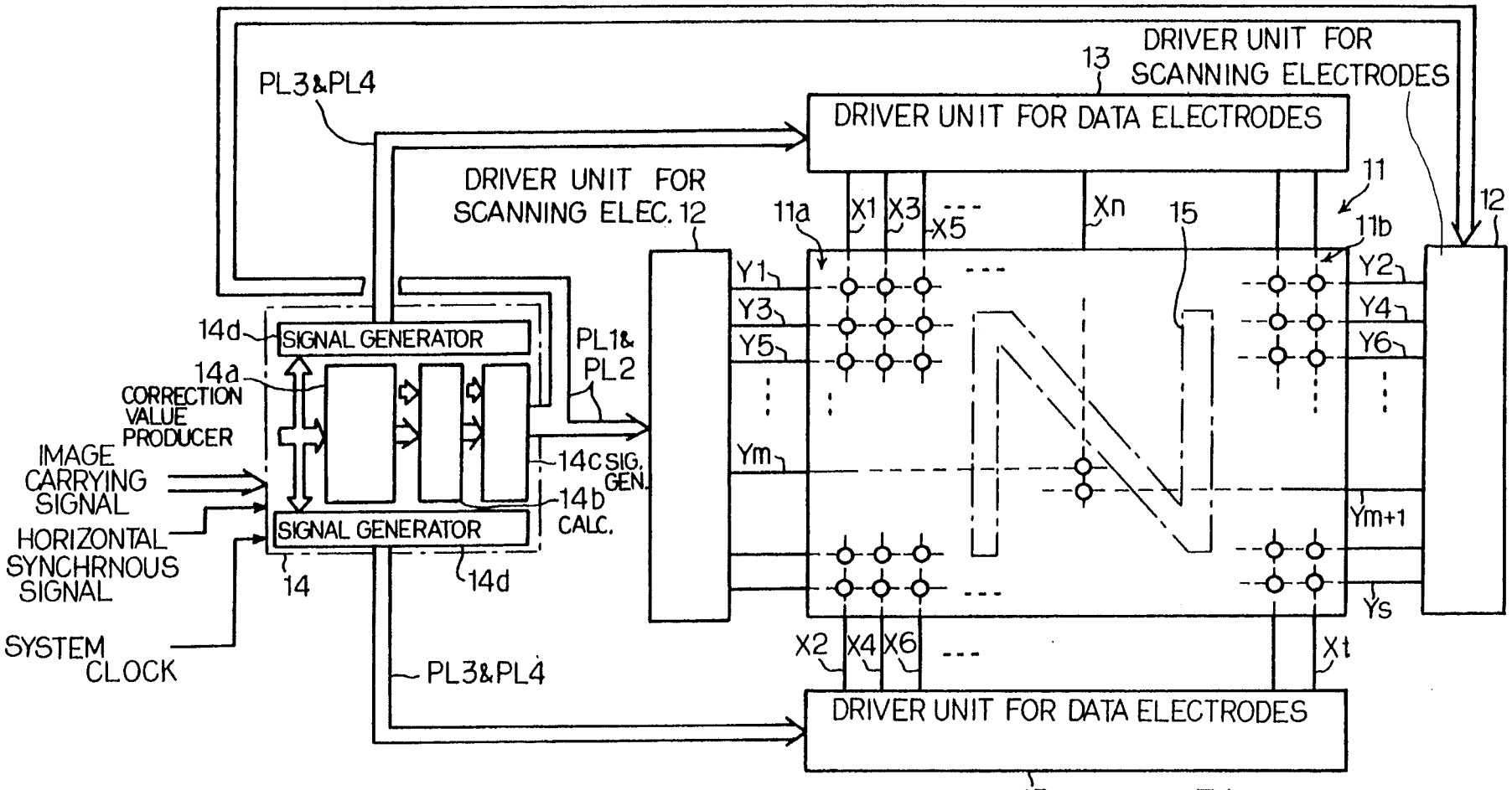
FIG. 3 is a block diagram showing the arrangement of an AC refresh type plasma display system according to the present invention.

Referring to FIG. 3 of the drawings, an AC refresh type plasma display system embodying the present invention largely comprises a plasma display panel unit 11 with scanning electrodes 11*a* and data electrodes 11*b*, a driver unit 12 for the scanning electrodes 11*a*, a driver unit 13 for the data electrodes 11*b*, and a controlling unit 14. The scanning electrodes 11*a* are respectively coupled with scanning signal lines Y1, Y2, Y3, Y4, Y5, Y6, . . . Ym, Ym+1, . . . and Ys, and the data electrodes 11*b* are respectively coupled with data signal lines X1, X2, X3, X4, X5, X6, . . . Xn, . . . and Xt. The driver unit 12 sequentially drives the scanning signal lines Y1 to Ys with a low frequency driving pulse train AD followed by a high frequency driving pulse train HD under the control of the controlling unit 14. The driver unit 13 selectively drives the data signal lines X1 to Xt with a low frequency antiphase driving pulse train AAD and a low frequency in-phase driving pulse train IAD also under the control of the controlling unit 14. The scanning electrodes 11*a* and the data electrodes 11*b* form a plurality of pixels arranged in a matrix of rows and columns. Small circles in the Figure respectively represent pixels in the matrix.

The controlling unit 14 is responsive to an image carrying signal indicative of pieces of visual information. A horizontal synchronous signal and a system clock signal are further supplied to the controlling unit 14. The horizontal synchronous signal is used for horizontal synchronization in the plasma display panel unit 11. The pieces of visual information are respectively assigned to the scanning electrodes, and each of the pieces of visual information designates pixels on the associated scanning electrode for illumination. For this reason, the controlling unit 14 allows the driver units 12 and 13 to sequentially drive the scanning electrodes 11*a* and to selectively drive the data electrodes 11*b* so that a visual image 15 is formed on the matrix of the pixels. In order to control the driver units 12 and 13, the controlling unit 14 produces a low frequency address pulse signal PL1, a high frequency hold pulse signal PL2, a low frequency antiphase address pulse signal PL3 and a low frequency in-phase address pulse signal PL4 as will be described hereinafter.

The controlling unit 14 largely comprises a correction value producing sub-unit 14*a*, a calculating sub-unit 14*b*, a first signal generating sub-unit 14*c* and a second signal generating sub-unit 14*d*. The first signal generating sub-unit 14*c* produces the low frequency address pulse signal PL1 and the high frequency hold pulse signal PL2, and sequentially supplies these pulse signals PL1 and PL2 to the driver unit 12. The driver unit 12 is responsive to the low frequency address pulse signal PL1 and the high frequency hold pulse signal PL2, and sequentially supplies the low frequency driving pulse train AD and the high frequency driving pulse train PL2 to the scanning electrodes 11*a*. On the other hand, the second signal generating sub-unit 14*d* produces the low frequency antiphase address pulse signal PL3 and the low frequency in-phase address pulse signal PL4, and supplies these address pulse signals PL3 and PL4 to the driver unit 13. The driver unit 13 is responsive to the low frequency antiphase address pulse signal PL3 and the low frequency in-phase address pulse signal PL4, and selectively supplies the low frequency antiphase driving pulse train AAD and the low frequency in-phase driving pulse train IAD to the data electrodes 11*b*. The pieces of visual information are sequentially supplied to the correction value producing sub-unit 14*a*, and the correction value producing sub-unit 14*a* determines by how much the hold pulses should be decreased or increased relative to a standard number for the high frequency hold pulse signal PL2. The decrement or increment is reported to the calculating sub-unit 14*b*, and the calculating sub-unit 14*b* calculates the modified frequency of the high frequency hold pulse signal PL2. Then, the first signal producing sub-unit 14*c* produces the high frequency hold pulse signal PL2 at the modified frequency after the low frequency address pulse signal PL1.

Figure 4:
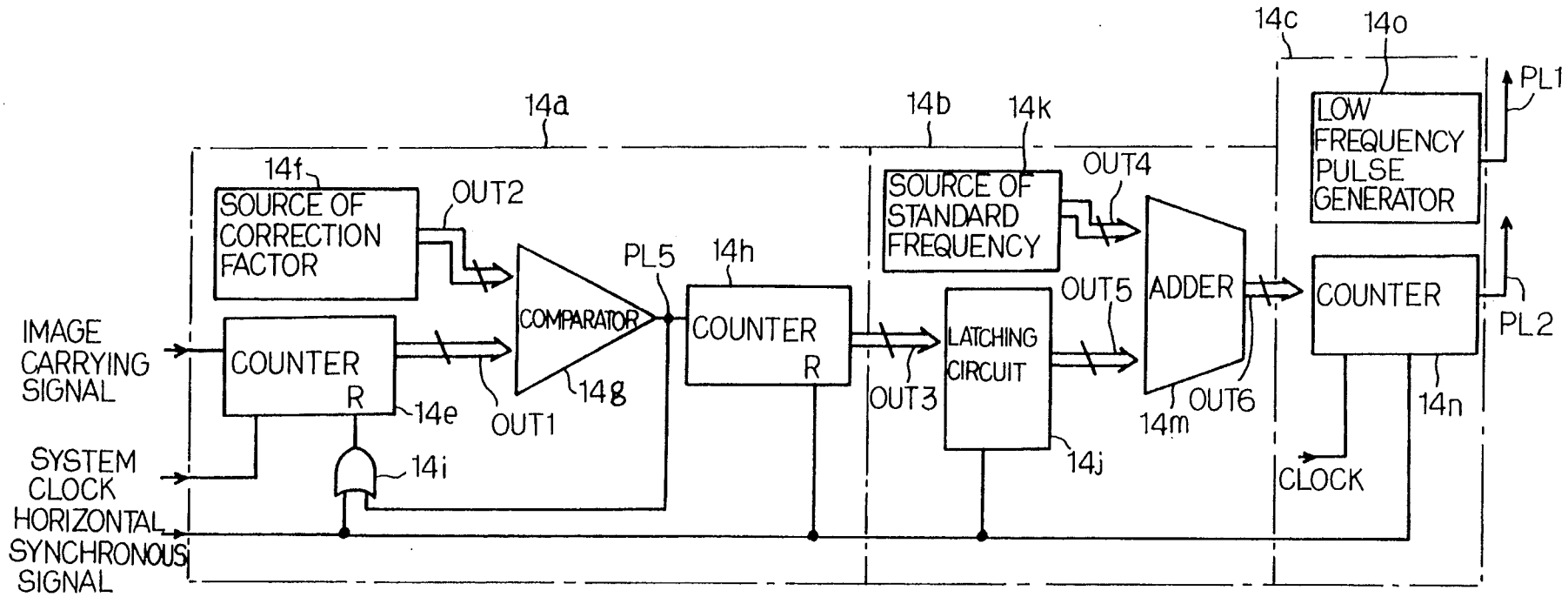
FIG. 4 is a block diagram showing the circuit arrangement of a controlling unit incorporated in the AC refresh type plasma display system shown in FIG. 3.

Turning to FIG. 4 of the drawings, the circuit arrangement of the controlling unit 14 is illustrated in detail. However, the circuit arrangement of the second signal generating sub-unit 14d is deleted from FIG. 4 so as to focus upon the modification procedure of the high frequency hold pulse signal PL2.

The correction value producing sub-unit 14a comprises a counter 14e, a source of correction factor 14f, a comparator 14g, a counter 14h and an OR gate 14i. The horizontal synchronous signal is supplied through the OR gate 14i to the reset node of the counter 14e, and clears the value kept in the counter 14e at the beginning of every horizontal sweeping. The horizontal synchronous signal also clears the value stored in the counter 14h at the beginning of every horizontal sweeping. The image carrying signal is indicative of the pieces of visual information, and each piece of visual information is supplied to the counter 14e while the first signal generating sub-unit 14c supplies the low frequency address pulse signal PL1 and the high frequency hold pulse signal PL2 modified with the previous piece of visual information to the driver unit 12. Since each of the pieces of visual information designates the pixels to be illuminated, the counter 14e picks up the pixels to be illuminated, and increments the value indicated by the digital output signal OUT1. The digital output signal OUT1 thus incremented is indicative of the value stored in the counter 14e or the number of the pixels to be illuminated, and is supplied to the comparator 14g. The source of correction factor 14f supplies a digital output signal OUT2 indicative of a correction factor CF to the comparator 14g, and the correction factor CF serves as a divisor of a predetermined value. Namely, the digital output signal OUT1 indicative of the number of the pixels to be illuminated is compared with the digital output signal OUT2 indicative of the correction factor CF, and the comparator 14g produces an output pulse signal PL5 when the value of the digital output signal OUT1 is matched with the correction factor CF. The output pulse PL5 increments the counter 14h, and resets the counter 14e. If the piece of visual information further designates the pixels to be illuminated, the counter 14e begins on incrementing the digital output signal OUT1 again. The value of the digital output signal OUT1 is matched with the correction factor CF again, the comparator 14g produces the output pulse PL5, and the output pulse PL5 increments the counter 14h as well as resets the counter 14e. Thus, the total number of the pixels to be illuminated are divided by the correction factor CF, and the quotient is stored in the counter 14h. The quotient represents a decrement or an increment, and a digital output signal OUT3 of the counter 14h is indicative of the decrement or the increment. Whether the quotient is indicative of a decrement or an increment is dependent upon a standard frequency of the high frequency hold pulse signal PL2 as will be described hereinbelow.

The calculating sub-unit 14b comprises a latching circuit 14j, a source of standard frequency 14k and an adder 14m. In this instance, the standard frequency is adjusted to the minimum value corresponding to the pixels on a single scanning electrode to be put out. Therefore, the quotient is indicative of an increment. The latching circuit 14j is responsive to the horizontal synchronous signal, and latches the digital output signal OUT3 indicative of the quotient or the increment. The source of standard frequency 14k stores a standard frequency of the high frequency hold pulse signal PL2, and produces a digital output signal OUT4 indicative of the standard frequency. The output signal OUT5 of the latching circuit 14j is supplied to the adder 14m, and the digital output signal OUT4 is also supplied from the source of standard frequency 14k to the adder 14m. The adder 14m adds the increment to the standard frequency, and determines a modified frequency for the high frequency hold pulse signal PL2.

The first signal generating sub-unit 14c comprises a counter 14n and a low frequency pulse generator 14o, and the digital output signal OUT6 indicative of the modified frequency is supplied from the adder 14m to the counter 14n. The counter 14n has been cleared with the horizontal synchronous signal, and the output signal OUT6 is loaded to the counter 14n. Then, the counter produces the hold pulses in synchronism with the clock signal, and the high frequency hold pulse signal HD is regulated to the modified frequency. The low frequency pulse generator 14o produces the low frequency address pulse signal PL1 prior to the high frequency hold pulse signal HD at the modified frequency. The circuit arrangement of FIG. 4 is implemented by hundreds of gates on a gate array, and is less expensive rather than the prior art solution described hereinbefore.

Figure 5:
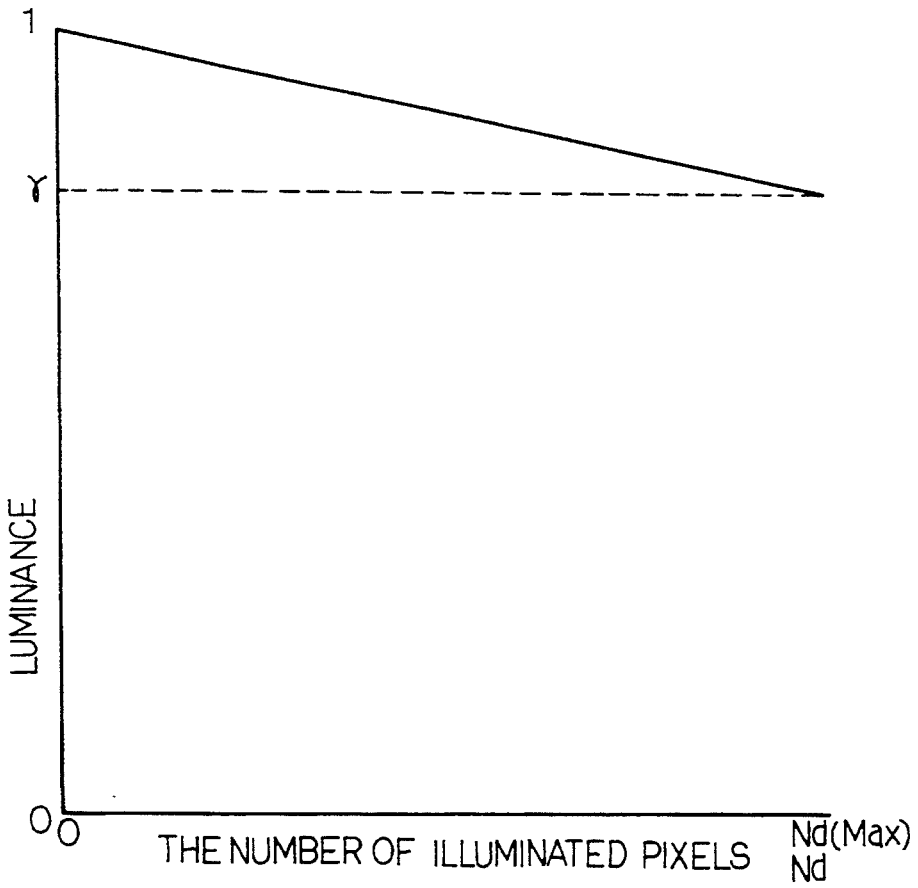
FIG. 5 is a graph showing the relation between the number of illuminated pixels and the luminance of each pixel.

FIG. 5 shows a relation between the number of illuminated pixels and the luminance of each pixel under a predetermined frequency of the hold pulse signal PL2. The luminance is inversely proportional to the number Nd of illuminated pixels, and, accordingly, is decreased toward the minimum value gamma at the maximum number Nd(max) of illuminated pixels. Incrementing the high frequency hold pulse signal HD compensates the decrement in luminance and the luminance of each pixel is kept constant regardless of the number of pixels to be illuminated. The following equation is established between the standard frequency Nho and $\gamma$ $$Nho + dNhmax = Nho/\gamma \quad (1)$$

where dNhmax is given as $$dNhmax = Nd(max)/CF \quad (2)$$

From Equations 1 and 2, the correction factor CF is given as $$CF = \gamma \times Nd(max)/(1-\gamma)\ Nho \quad (3)$$

By way of example, Nd(max) is 640 pixels, Nho is 80 pulses, and gamma is 0.8. Then, the correction factor is about 32.

Figure 6:
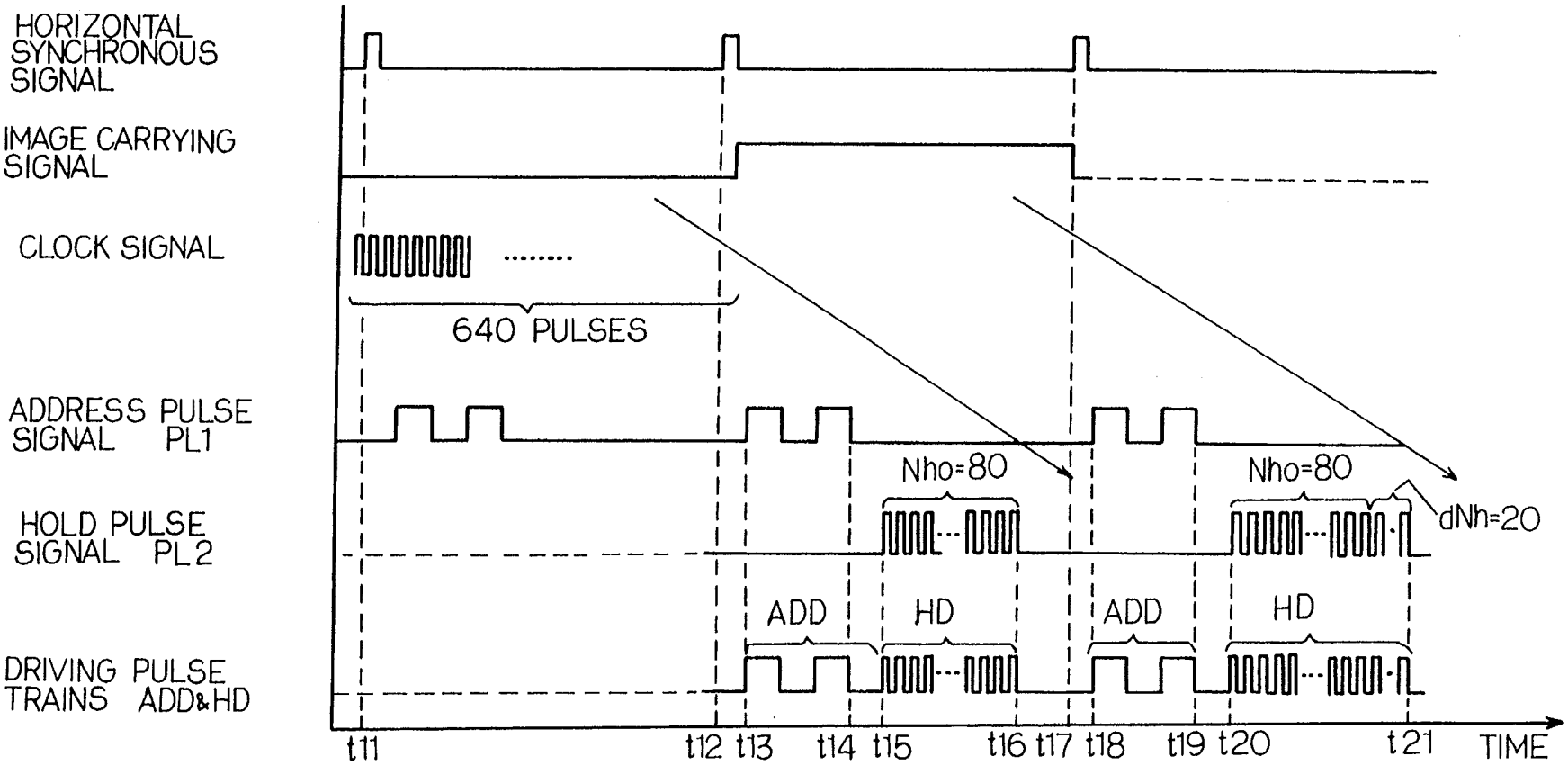
FIG. 6 is a diagram showing a controlling sequence of the AC refresh type plasma display system according to the present invention.

Description is hereinbelow made regarding operation of the AC refresh type plasma panel display system with reference to FIG. 6 and with further resort to the above example. If the horizontal synchronous signal takes place at time t11, a piece of visual information indicative of Nd =zero is supplied to the counter 14e, and the counter 14h produces the digital output signal OUT3 indicative of the increment dNh=zero. Since the standard frequency Nho is 80 pulses per unit time period, the adder 14m supplies the digital output signal OUT6 indicative of 80 pulses per unit time period to the counter 14n. Firstly, the low frequency pulse generator 14o produces the low frequency address pulse signal PL1 from time t13 to time t14, and, thereafter, the counter 14n produces the high frequency hold pulse signal PL2 at the standard frequency of 80 pulses per unit time period from time t15 to time t16. When supplied with the low frequency address pulse signal PL1 and the high frequency hold pulse signal HD, the driver unit 12 supplies the low frequency driving pulse train ADD and the high frequency driving pulse train HD to one of the scanning electrodes 11*a*. Since no pixel on the scanning electrode is illuminated, the driver unit 13 does not supply any low frequency antiphase driving pulse train to the data electrodes, and none of the pixels on the scanning line are illuminated.

At time t12, the next horizontal synchronous signal takes place, and the next piece of visual information requests the plasma panel display system to illuminate all of the pixels on the next scanning line. Then, the counter 14*e* increments the digital output signal OUT1, and the comparator 14*g* resets the counter 14*e* twenty times. The counter 14*e* increments the digital output signal OUT3 to 20, and the latching circuit stores the digital output signal OUT3 indicative of the increment dNh of 20 in synchronism with the horizontal synchronous signal at time t17. The adder calculates the sum of the standard frequency Nho of 80 pulses and the increment dNh of 20 pulses, and produces the digital output signal OUT6 indicative of 100 pulses per unit time period. Since the decrement gamma is 0.8, Equation 1 is satisfied as $$Nho=0.8\times 100/80=1 \quad (4)$$

The sum is loaded to the counter 14*n*, and the counter produces the high frequency hold pulse signal PL2 at the modified frequency of 100 pulses from time t20 to time t21 after production of the low frequency address pulse signal PL1 between times t18 and t19. The low frequency address pulse signal PL1 and the high frequency hold pulse signal PL2 are sequentially supplied to the driver unit 12, and the driver unit supplies the low frequency driving pulse train AD and the high frequency driving pulse train HD at the modified frequency to the next scanning electrode. The driver unit 13 supplies the low frequency antiphase driving signal AAD to all of the data electrodes 11*b*, and all of the pixels on the next scanning line are illuminated.

As will be understood from the foregoing description, the high frequency driving pulse train HD at the modified frequency supplements current when a large number of pixels are to be illuminated, and the luminance of each pixel is substantially constant regardless of the piece of visual information.

Although particular embodiments of the present invention have been shown and described, it will be obvious to those skilled in the art that various changes and modifications may be made without departing from the spirit and scope of the present invention.

What is claimed is:

1. An AC refresh type plasma display system for reproducing visual images represented by visual information, comprising:

a) a plasma display panel unit having a plurality of scanning electrodes respectively associated with a plurality of scanning lines, and a plurality of data electrodes for forming a plurality of addressable pixels, said visual information having pieces of visual information respectively assigned to said scanning lines, each of said pieces of visual information designating pixels on the associated scanning line to be illuminated;

b) a first driver unit coupled with said plurality of scanning electrodes, and responsive to a first address pulse signal and a hold pulse signal for sequentially driving said plurality of scanning electrodes;

c) a second driver unit coupled with said plurality of data electrodes, and responsive to a second address pulse signal for selectively driving said plurality of data electrodes, thereby selectively illuminating said plurality of pixels for reproducing said visual images;

d) a controlling unit coupled with said first and second driver units for distributing said first address pulse signal, said hold pulse signal and said second address pulse signal, and comprising a correction value producing means responsive to each of said pieces of visual information, and operative to calculate a correction value from said each of said pieces of visual information, a calculating means supplied with said correction value and an initial value indicative of a standard frequency of a standard hold pulse signal, and operative to calculate a modified frequency for modifying said standard frequency of said standard hold pulse signal, and a signal generating means coupled with said calculating means for producing said hold pulse signal.

2. An AC refresh type plasma panel display system as set forth in claim 1, in which said correction value producing means comprises a source of correction factor producing a first output signal indicative of a correction factor, a first counter supplied with each of said pieces of visual information in synchronism with a horizontal synchronous signal, and incrementing a value of a second output signal, a comparator operative to compare the value of said second output signal with said correction factor and to produce an output pulse when the value of said second output signal is matched with said correction factor, a logic gate responsive to both of said horizontal synchronous signal and said output pulse for resetting said first counter, and a second counter reset with said horizontal synchronous signal, and incrementing a third output signal indicative of said correction value when said output pulse is supplied thereto.

3. An AC refresh type plasma panel display system as set forth in claim 2, in which said calculating means comprises a source of standard frequency for producing a fourth output signal indicative of said standard frequency, a latching circuit responsive to said horizontal synchronous signal for storing said correction value, and producing a fifth output signal indicative of said correction value, and an adder receiving said fourth and fifth output signals, and producing a sixth output signal indicative of said modified frequency.

4. An AC refresh type plasma panel display system as set forth in claim 2, in which said signal generating means comprises a third counter reset with said horizontal synchronous signal, and storing said modified frequency for producing said hold pulse signal at said modified frequency.

5. An AC refresh type plasma panel display system as set forth in claim 1, in which said calculating means comprises a source of standard frequency for producing a standard frequency output signal indicative of said standard frequency, a latching circuit responsive to a horizontal synchronous signal for storing said correction value, and producing a correction value output signal indicative of said correction value, and an adder receiving said standard frequency output signal and said correction value output signal, and producing a modified frequency output signal indicative of said modified frequency.

6. An AC refresh type plasma panel display system as set forth in claim 1, in which said signal generating means comprises a counter that is reset with a horizontal synchronous signal and that stores said modified frequency for producing said hold pulse signal at said modified frequency.

7. An AC refresh type plasma panel display system as set forth in claim 1, wherein, for the purpose of calculating said modified frequency, said correction value causes said initial value to be incremented.

8. An AC refresh type plasma panel display system as set forth in claim 1, wherein, for the purpose of calculating said modified frequency, said correction value causes said initial value to be decremented.

9. An AC refresh type plasma display system for reproducing visual images represented by visual information, comprising:

a) a plasma display panel unit having a plurality of scanning electrodes respectively associated with a plurality of scanning lines, and a plurality of data electrodes for forming a plurality of addressable pixels, said visual information having pieces of visual information respectively assigned to said scanning lines, each of said pieces of visual information designating pixels on the associated scanning line to be illuminated;

b) a first driver unit coupled with said plurality of scanning electrodes, and responsive to a first address pulse signal and a hold pulse signal for sequentially driving said plurality of scanning electrodes;

c) a second driver unit coupled with said plurality of data electrodes, and responsive to a second address pulse signal for selectively driving said plurality of data electrodes, thereby selectively illuminating said plurality of pixels for reproducing said visual images;

d) a controlling unit coupled with said first and second driver units for distributing said first address pulse signal, said hold pulse signal and said second address pulse signal, and comprising a correction value producer responsive to each of said pieces of visual information, and operative to calculate a correction value from said each of said pieces of visual information, a calculator supplied with said correction value and an initial value indicative of a standard frequency of a standard hold pulse signal, and operative to calculate a modified frequency for modifying said standard frequency of said standard hold pulse signal, and a signal generator coupled with said calculating means for producing said hold pulse signal.

10. An AC refresh type plasma panel display system as set forth in claim 9, in which said correction value producer comprises a source of correction factor producing a first output signal indicative of a correction factor, a first counter supplied with each of said pieces of visual information in synchronism with a horizontal synchronous signal, and incrementing a value of a second output signal, a comparator operative to compare the value of said second output signal with said correction factor and to produce an output pulse when the value of said second output signal is matched with said correction factor, a logic gate responsive to both of said horizontal synchronous signal and said output pulse for resetting said first counter, and a second counter reset with said horizontal synchronous signal, and incrementing a third output signal indicative of said correction value when said output pulse is supplied thereto.

11. An AC refresh type plasma panel display system as set forth in claim 9, in which said calculator comprises a source of standard frequency for producing a standard frequency output signal indicative of said standard frequency, a latching circuit responsive to a horizontal synchronous signal for storing said correction value, and producing a correction value output signal indicative of said correction value, and an adder receiving said standard frequency output signal and said correction value output signal, and producing a modified frequency output signal indicative of said modified frequency.

12. An AC refresh type plasma panel display system as set forth in claim 9, in which said signal generator comprises a counter that is reset with a horizontal synchronous signal and that stores said modified frequency for producing said hold pulse signal at said modified frequency.

13. An AC refresh type plasma panel display system as set forth in claim 9, wherein, for the purpose of calculating said modified frequency, said correction value causes said initial value to be incremented.

14. An AC refresh type plasma panel display system as set forth in claim 9, wherein, for the purpose of calculating said modified frequency, said correction value causes said initial value to be decremented.

* * * * *